United States Patent [19]

Mase et al.

[11] 4,267,809

[45] May 19, 1981

[54] EXHAUST GAS RECIRCULATION CONTROL SYSTEM

[75] Inventors: Yasushi Mase; Toshikazu Okamura, both of Tokyo, Japan

[73] Assignee: Nissan Motor Company, Limited, Yokohama, Japan

[21] Appl. No.: 45,410

[22] Filed: Jun. 4, 1979

[30] Foreign Application Priority Data

Jul. 5, 1978 [JP] Japan ..... 53-80944

[51] Int. Cl.[3] ..... F02B 47/08; F02P 5/00

[52] U.S. Cl. ..... 123/409; 123/568

[58] Field of Search ..... 123/119 A, 117 A; 125/568, 409, 407

[56] References Cited

U.S. PATENT DOCUMENTS

| | | | |
|---|---|---|---|
| 3,606,871 | 9/1971 | Gropp et al. | 123/117 A |
| 3,638,626 | 2/1972 | Marshall | 123/117 A |
| 3,804,326 | 4/1974 | McIntire | 123/117 A |
| 3,885,537 | 5/1975 | Diehl | 123/119 A |
| 3,941,105 | 3/1976 | Yagi et al. | 123/119 A |
| 4,056,083 | 11/1977 | Wakita | 123/119 A |
| 4,142,495 | 3/1979 | Lahiff | 123/119 A |

*Primary Examiner*—Wendell E. Burns
*Attorney, Agent, or Firm*—Schwartz, Jeffery, Schwaab, Mack, Blumenthal & Koch

[57] ABSTRACT

An exhaust gas recirculation control system for an internal combustion engine for removing nitrogen oxides (NOx) in exhaust gases comprises a positive pressure delay valve in a negative pressure passage for introducing intake negative pressure in the proximity of a throttle valve of a carburetor into an exhaust gas recirculation control valve to maintain the negative pressure therein during an acceleration, thereby effecting the exhaust gas recirculation even when accelerating to purify the nitrogen oxides in the exhaust gas.

The exhaust gas recirculation control system further comprises a positive pressure delay valve in an advance negative pressure passage for introducing the intake negative pressure in the vicinity of the throttle valve of a carburetor into a distributor and synchronized with the above positive pressure delay valve to maintain the distributor advanced, thereby keeping a good combustion of fuel mixture.

4 Claims, 3 Drawing Figures

EXHAUST GAS RECIRCULATION CONTROL SYSTEM

BACKGROUND OF THE INVENTION

1. Field of the Invention

This invention relates to an exhaust gas recirculation control system used for removing nitrogen oxides (NOx) in exhaust gases discharged from internal combustion engines.

2. Description of the Prior Art

In conventional exhaust gas recirculation control systems hitherto used, an exhaust gas recirculation control valve for controlling the recirculation gas flow is generally operated by intake negative pressure introduced thereinto from a throttle valve of a carburetor through a negative pressure passage including in its midway a negative pressure regulator which is operated by an exhaust gas pressure to regulate the intake negative pressure in order to maintain an optimum amount of the recirculation gas flow according to a condition of the engine operation.

With this arrangement of the prior art, however, the exhaust gas recirculation control valve is apt to close prematurely when the throttle valve is widely opened, for example, in accelerating the engine, so that the nitrogen oxides in the exhaust gases cannot be purified. Moreover, when the engine is accelerated, the nitrogen oxides in the exhaust gases are much more than those during a normal travelling. Accordingly, it is necessary to increase the recirculation gas flow when accelerating. The control systems of the prior art are not sufficient to achieve a complete purification of the nitrogen oxides in the exhaust gases.

SUMMARY OF THE INVENTION

It is therefore an object of the invention to provide an improved exhaust gas recirculation control system which overcomes the above disadvantages in the prior art.

It is another object of the invention to provide an exhaust gas recirculation control system comprising a positive pressure delay valve in a negative pressure passage for introducing intake negative pressure in the proximity of a throttle valve of a carburetor into an exhaust gas recirculation control valve to maintain the negative pressure in the exhaust gas recirculation flow control valve during an acceleration, which would otherwise raise due to the intake negative pressure raised by the acceleration, thereby enabling the exhaust gas recirculation to purify the nitrogen oxides in the exhaust gases.

It is further object of the invention to provide an exhaust gas recirculation control system further comprising a positive pressure delay valve provided in an advance negative pressure passage for introducing the intake negative pressure in the proximity of the throttle valve of the carburetor into a distributor, and synchronized with the above positive pressure delay valve to maintain the distributor advanced, thereby keeping a good combustion of fuel mixture.

The invention will be more fully understood by referring to the following detailed specification and claims taken in connection with the appended drawings.

DETAILED DESCRIPTION OF THE PREFERRED EMBODIMENTS

Figure 1:
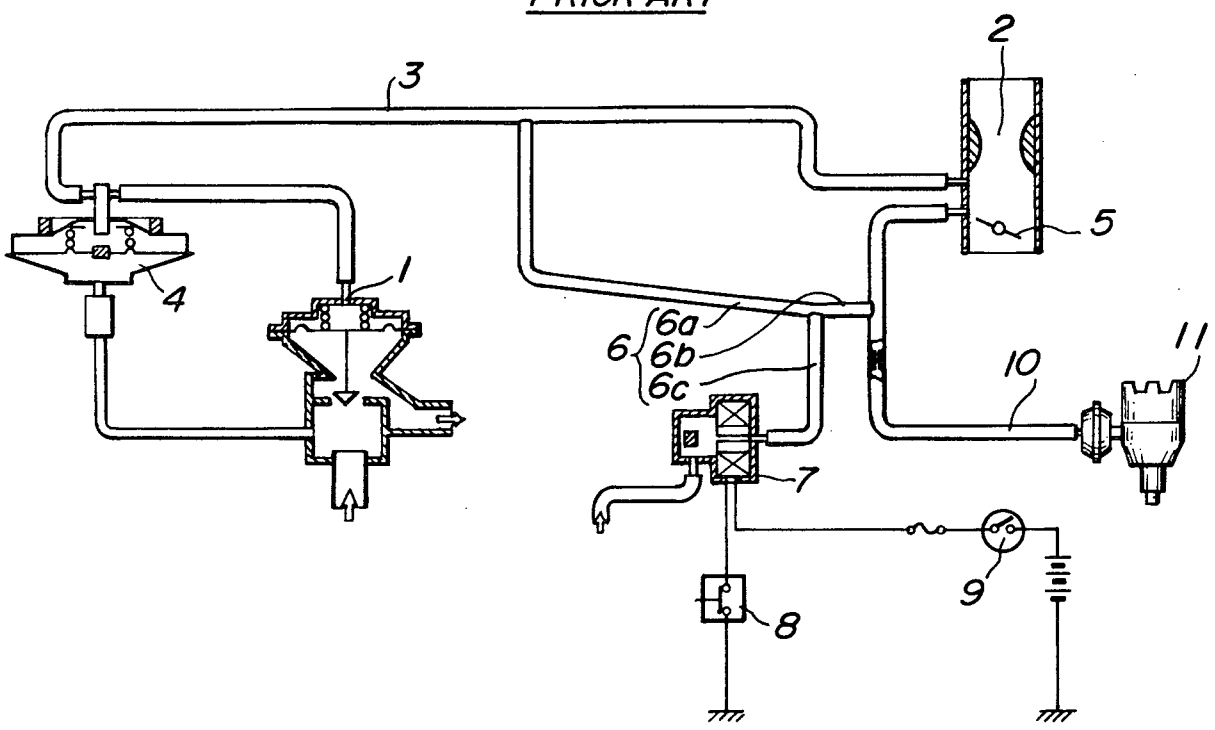
FIG. 1 PRIOR ART
FIG. 1 illustrates an exhaust gas recirculation control system in the prior art.

FIG. 1 illustrates an exhaust gas recirculation control system of prior art, including an exhaust gas recirculation control valve 1 for controlling the recirculation gas flow adapted to be actuated by intake negative pressure introduced thereinto from the proximity of a throttle valve 5 of a carburetor 2 through a negative pressure passage 3 including in its midway a negative pressure regulator 4 which is operated by an exhaust gas pressure to regulate the intake negative pressure in order to keep a suitable amount of the recirculation gas flow according to a condition of the engine operation.

With this arrangement, however, the exhaust gas recirculation control valve 1 tends to close prematurely when the throttle valve is widely opened to raise the intake negative pressure therein, for example, when accelerating, with the result that the purification of the nitrogen oxides cannot be effected. In addition, when the engine is accelerated, the nitrogen oxides (NOx) in the exhaust gases are much more than those during a normal travelling, because a great amount of fuel and air mixture is fed into a combustion chamber of the engine by a completely trodden accel pedal to increase the intake mixture per one stroke which would in turn increase the calorific valve in combustion of the mixture which would raise the temperature in the combustion chamber to increase the nitrogen oxides (NOx) due to reaction with the air.

Accordingly, it is absolutely necessary to increase the recirculation gas flow when accelerating in order to improve the purification of the exhaust gases containing the nitrogen oxides (NOx). The control system of the prior art shown in FIG. 1 is not sufficient to overcome this problem.

Referring to FIG. 1, air passages 6, an electromagnetic valve 7 and a top gear switch 8 are provided to stop the exhaust gas recirculation when travelling at a high speed. The top gear switch 8, which senses the high speed drive, actuates the electromagentic valve 7 to flow the air or atmosphere from an air passage **6*c* into air passages 6*a* and 6*b* and hence an advance negative pressure passage 10 communicating the negative pressure passage 3 with a distributor 11 so that the negative pressures in these passages will raise to close the exhaust gas recirculation control valve 1. A reference numeral 9 illustrates an ignition switch. With this arrangement, the air is fed to both the exhaust gas recirculation control valve 1 and a distributor 11** simultaneously, because it is not necessary to advance the distributor owing to an ignition quality of the mixture improved by the decrease of the unburned components therein resulting from the decrease of the recirculation gas.

Figure 2:
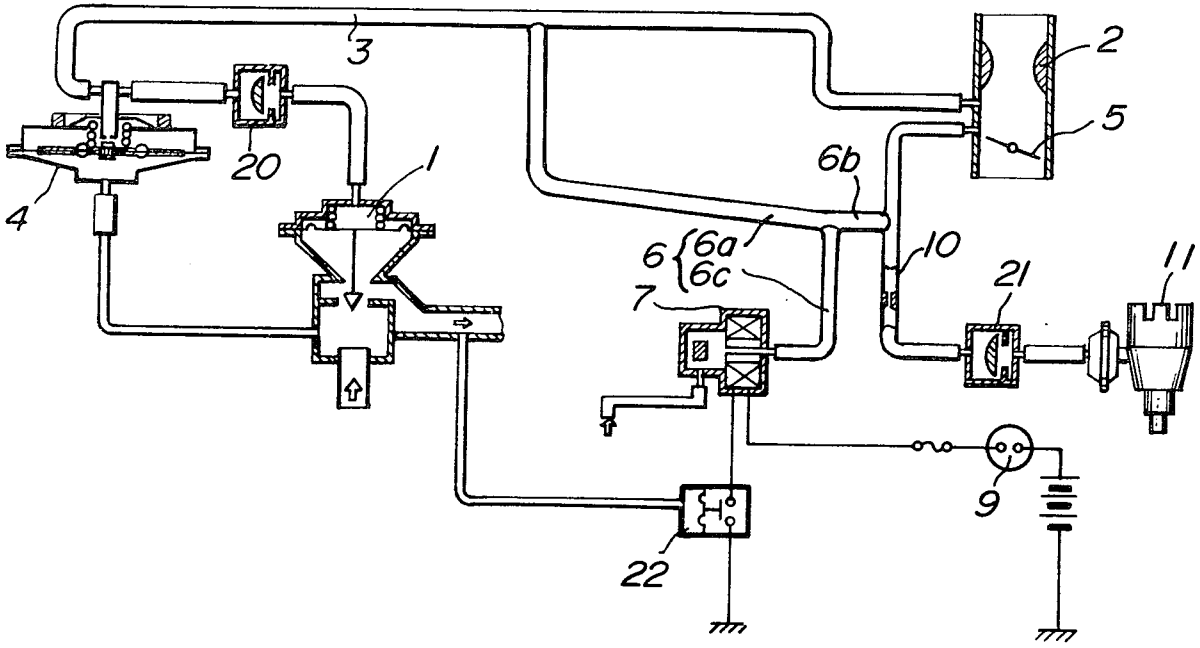
FIG. 2 illustrates one embodiment of an exhaust gas recirculation control system according to the invention.

Referring to FIG. 2 illustrating one embodiment of the exhaust gas recirculation control system according to the invention, a negative pressure passage 3 between a negative pressure regulator 4 and an exhaust gas recirculation control valve 1 includes a positive pressure delay valve 20. In the embodiment shown in FIG. 2, the negative pressure regulator 4 is provided upstream of the positive pressure delay valve. However, the negative pressure regulator 4 may be provided downstream of the positive pressure delay valve as the case may be. A positive pressure delay valve 21 similar in construction to the valve 20 is provided in an advance negative pressure passage 10 at a location near to a distributor 11 and remote from air passages 6 connected to the advance negative pressure passage 10.

Figure 3:
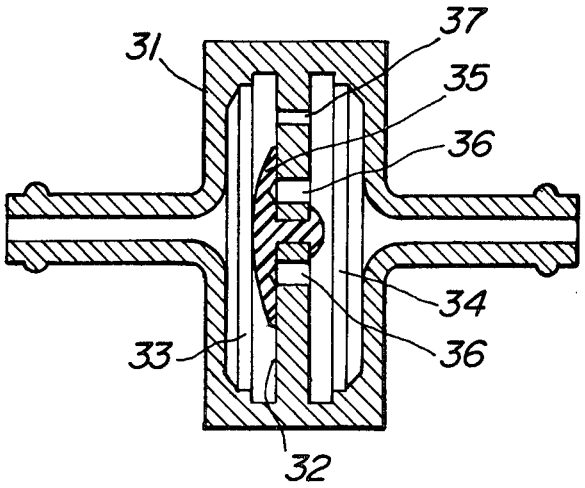
FIG. 3 is a sectional view of a positive pressure delay valve to be used in the system according to the invention.

FIG. 3 shows a construction of the positive pressure delay valves 20 and 21 in detail. As the valves 20 and 21 are substantially the same in construction, only one of the valves will be explained herein. A casing 31 comprises a partition 32 provided therein to divide the interior of the casing into two chambers 33 and 34. The partition 32 is provided in its center with a rubber valve 35 in the form of a mushroom secured thereto to close orifices 36 formed in the partition. The partition is further formed at a location radially outside of the rubber valve 35 with a small orifice 37 which serves to equalize the pressures in the chambers 34 and 35 when a certain period of time has elapsed. A sintered metal plug may be fitted in the orifice 37 to obtain the most suitable flow resistance therethrough for this purpose. In this case, it is preferable to provide a larger diameter orifice 37 or a plurality of small orifices 37. The rubber valve 35 opens the orifices 36 when the negative pressure in the chamber 33 is lower than that in the chamber 34 and closes the orifices 36 when the negative pressure in the chamber 33 is higher. According to the invention, the chamber 33 is communicated to a passage to a carburetor 2 and the chamber 34 is communicated to a passage to an exhaust gas recirculation control valve 1 or a distributor.

A negative pressure valve 22 senses a deceleration to operate an electromagnetic valve 7 for introducing the air into the air passages 6 because of less NOx during the deceleration which does not need the exhaust gas recirculation. The negative pressure valve 22 is substantially identical in construction with the top gear switch 8 in FIG. 1. Other components and arrangements are similar to the system of the prior art shown in FIG. 1, which will not be described in further detail.

The operation of the system according to the invention will be explained hereinafter. When a driver fully treads on an accelerator pedal to open a throttle valve 5 of a carburetor 2 completely for an acceleration, the intake negative pressure and hence the negative pressure in the negative pressure passage could be lowered. However, the negative pressure passage 3 between the positive pressure delay valve 20 and the exhaust gas recirculation control valve 1 will contain a negative pressure therein because of the positive pressure delay valve 20. In other words, the pressure in the chamber 33 of the delay valve 20 is substantially at the atmospheric pressure, while the pressure in the chamber 34 is at a negative pressure, so that the rubber valve 35 is urged by the pressure difference in a direction to close the orifices 36 thereby keeping the negative pressure in the chamber 34 which maintains the exhaust gas recirculating control valve 1 opened. Because of the small orifice 37, the pressures in the chambers 34 and 35 are equalized when a short period of time has elapsed. The positive pressure delay valve 21 provided in the advance negative pressure passage 10 also operates in the same manner to keep the distributor advanced.

According to the invention, as above described, even when accelerating, the exhaust gas recirculation is effected to purify NOx and simultaneously accomplishes correct ignition times to more improve the purification of the exhaust gas.

While the invention has been particularly shown and described with reference to the preferred embodiments thereof, it will be understood by those skilled in the art that the foregoing and other changes in form and details can be made therein without departing from the spirit and scope of the invention.

What is claimed is:

1. In an exhaust gas recirculation control system including a negative pressure passage for introducing intake negative pressure in the proximity of a throttle valve of a carburetor into an exhaust gas recirculation control valve, which control valve is constructed to open when said intake negative pressure is applied thereto, and an advance negative pressure passage for introducing the intake negative pressure in the proximity of the throttle valve of the carburetor into a distributor, the improvement comprising positive pressure delay valves provided in said negative pressure and advance negative pressure passages, respectively, said delay valves each comprising a bypass orifice and a check valve, said delay valves connected in said passages for permitting flow through said check valve from said control valve and said distributor, respectively, to said intake negative pressure.

2. A system as set forth in claim 1, wherein a negative pressure regulator is provided in said negative pressure passage upstream of said positive pressure delay valve provided in said negative pressure passage.

3. A system as set forth in claim 1 or 2, wherein to said negative pressure passage are connected air passages for introducing atmosphere thereinto with the aid of an electromagnetic valve which operates when it senses a deceleration of an engine.

4. A system as set forth in claim 1 or 2, wherein to said negative pressure and advance negative pressure passages are respectively connected air passages for introducing the atmosphere thereinto with the aid of an electromagnetic valve which operates when it senses a deceleration of an engine.

* * * * *